US006311359B1

(12) United States Patent
Brezler, III

(10) Patent No.: US 6,311,359 B1
(45) **Date of Patent: *Nov. 6, 2001**

(54) TAPERED BRUSH BRISTLES WITH CLAY OR SILICA ADDITIVE AND BRUSHES MADE THEREFROM

(75) Inventor: Russel Alfred Brezler, III, Mineral Wells, WV (US)

(73) Assignee: E.I. du Pont de Nemours and Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/318,154

(22) Filed: May 25, 1999

(51) Int. Cl.[7] ..... A46B 15/00

(52) U.S. Cl. ..... 15/159.1; 15/207.2

(58) Field of Search ..... 428/372, 399, 428/400; 15/159.1, 207.2, DIG. 5, DIG. 6

(56) References Cited

U.S. PATENT DOCUMENTS

| | | | | |
|---|---|---|---|---|
| 2,418,492 | | 4/1947 | Alfthan et al. | 13/3 |
| 2,697,009 | | 12/1954 | Ingraito | 300/2 |
| 2,911,761 | | 11/1959 | Anderson . | |
| 3,295,156 | * | 1/1967 | Brant | 15/DIG. 5 |
| 3,618,154 | | 11/1971 | Muhler et al. . | |
| 3,706,111 | | 12/1972 | Curtis et al. | 15/159 A |
| 4,279,053 | | 7/1981 | Payne et al. | 15/159 A |
| 4,376,746 | | 3/1983 | Ward et al. | 264/167 |
| 4,381,325 | * | 4/1983 | Masuda et al. | 428/399 |
| 5,032,456 | | 7/1991 | O'Brien et al. | 428/398 |
| 5,128,208 | | 7/1992 | Bond et al. | 428/397 |
| 5,305,489 | * | 4/1994 | Lage | 15/207.2 |
| 5,462,798 | | 10/1995 | Gueret . | |
| 5,491,865 | * | 2/1996 | Gueret | 15/DIG. 6 |
| 5,722,106 | | 3/1998 | Masterman et al. . | |
| 5,727,106 | | 3/1998 | Sutehall et al. | 385/100 |
| 5,987,688 | * | 11/1999 | Roberts et al. | 15/207.2 |
| 5,991,957 | * | 11/1999 | Watanabe | 15/DIG. 5 |
| 5,996,157 | * | 12/1999 | Smith et al. | 15/DIG. 5 |
| 6,174,600 | | 1/2001 | Brown et al. . | |

FOREIGN PATENT DOCUMENTS

| | | | | |
|---|---|---|---|---|
| 1007032 | | 3/1977 | (CA) . | |
| 598821 | * | 2/1948 | (GB) | 15/207.2 |
| WO 93/14251 | | 7/1993 | (WO) . | |

OTHER PUBLICATIONS

John P. Paul, "Recycling (Rubber)", *Encyclopedia of Chemical Technology*, John Wiley & Sons, 21, 22–46, 1997.

G. H. Coleman, R. M. Morgan and W. B. Happoldt, "Improved Techniques for Paint Brush Testing", *E. I. du Pont de Nemours & Co.*, 1–11(& Figure List & Drwg.), Mar. 1956.

DuPont Filaments Product Information brochure, "Industrial Brushes With Tynex® A Filaments"—"The Finishing Touch", DuPont Filaments, Wilmington, DE 19898.

DuPont Filaments brochure "One brush of TYNEX® 'A' can outlast 300 pads—and reduce cleaning costs", DuPont, Filaments, Wilmington, DE 19880–0029.

DuPont Filaments brochure "Brushes made with DuPont TYNEX® A save money versus floor pads", DuPont Company, Wilmington, DE 19898.

DuPont Filaments Product Information brochure, "TYNEX® A Abrasive Filament"—"The Finishing Touch", DuPont Filaments, Wilmington, DE 19898.

(List continued on next page.)

*Primary Examiner*—Terrence R. Till

(57) ABSTRACT

Tapered thermoplastic polymer brush bristles having a clay or silica additive for improved performance of coating, such bristles being particularly useful in paintbrush, mascara brush, nail polish brush and cosmetic brush consumer applications.

7 Claims, 2 Drawing Sheets

OTHER PUBLICATIONS

DuPont Filaments Product Information brochure "Floor Care Brushes With TYNEX® A Filaments"—"The Unique Abrasive", DuPont Filaments, Wilmington, DE 19898.

DuPont Filaments Technical Information brochure, "TYNEX® A: The Finishing Touch", DuPont Filaments, Wilmington, DE 19898.

* cited by examiner

TAPERED BRUSH BRISTLES WITH CLAY OR SILICA ADDITIVE AND BRUSHES MADE THEREFROM

FIELD OF THE INVENTION

The present invention relates to textured tapered filaments. Particularly, the invention relates to tapered filaments of thermoplastic polymer having a clay or silica additive to increase the surface of the filament and improve pickup and release performance of coatings when used in a brush application.

BACKGROUND OF THE INVENTION

Synthetic filaments produced from thermoplastic polymers have long been used as an alternative for natural bristles such as hog hair in the manufacture of paintbrushes. These thermoplastic polymers provide advantages over natural bristles in cost, consistency of quality, and performance, especially in modem day paintbrushes as painting has transitioned from solvent based to water based. The thermoplastic filaments are often tapered to provide a large diameter end (butt) which is contained within the ferrule of the brush while providing a smaller diameter end (tip) at the end of the paintbrush. A typical paintbrush, as shown in FIG. 3, has a handle 2, a ferrule 4, and bristles 6.

The synthetic filaments can be produced from a wide variety of thermoplastic polymers including polyamides, polyesters (U.S. Pat. No. 3,706,111), and polyolefins, in a wide variety of configurations including solid and hollow, and in a wide variety of cross-sections, including circular, oval, trilocular, tetralocular, lobate (U.S. Pat. Nos. 4,279,053 and 4376,746, Can. Pat. No. 1,007,032), or may contain multiple voids. Much work has been done in the trade to improve paint pickup and paint release of paintbrushes by experimenting with blends of different polymers, configurations, and cross-sections. However, with all the inventions in these areas introduced to the trade in the past, the highest quality, best performing, professional brushes of today are still produced from tapered solid round filaments of nylon 6,12 (specifically filaments sold under the trademark TYNEX® filaments by E. I. du Pont de Nemours and Company) blended with tapered solid round filaments of polybutylene terephthalate (specifically filaments sold under the trademark OREL® filaments by E. I. du Pont de Nemours and Company).

U.S. Pat. No. 5,032,456 teaches a microcellular filament to better simulate the surface of natural hog bristle for paint application. This filament has a porous surface to improve paint pickup and hold, but does not show any improvement in paint release. Also, because of these pores on the surface, brushes made with these filaments can be hard to clean, and as a result, these filaments are not used in premium professional brushes today. In U.S. Pat. No. 5,128,208, improved paint pickup in oil paints is accomplished by a filament that is easily flagged. However, this filament is not preferred because it is difficult to tip without flagging and does not provide any improvement in paint release, especially of water based paints. U.S. Pat. No. 4,279,053 discloses trilocular and tetralocular filaments to provide improved flagging and lower filament densities. Although the improved flagging accomplished with these filaments can improve the paint pickup of the brush, the trilocular filaments do not have the required stiffness and bend recovery that allow for use in premium professional brushes.

Significant work has been done in the past to add clay or silica of various sizes and of various amounts to nylon and polyester filaments and fibers to improve physical properties such as strength, fracture toughness, or abrasiveness. E. I. du Pont de Nemours and Company sells an abrasive filament, marketed under trade name TYNEX® A, which contains aluminum silicate, but is not tapered, and is not used in or recommended for use in paintbrushes. U.S. Pat. No. 5,722,106 discloses the addition of clay to nylon and polyester level (non-tapered) filaments as a polishing agent for use in toothbrushes. But the disclosure does not consider pickup and release properties or the use of clay additives for tapered filaments for use in coating applications. Clay or silica has also been added to filaments and fibers to better imitate natural bristles in surface appearance and feel, but no work has been done where clay was added to tapered filaments for use in paintbrushes or other coating application uses. Furthermore, no tapered filament has shown the magnitude of improvement in paint pickup and release and paint stripe length as the filament of this invention.

SUMMARY OF THE INVENTION

The present invention provides an improved polymeric tapered brush bristle produced with 0.1% to 10% clay or silica additive by weight of the total composition. The clay additive modifies the surface of the filament and improves the pickup and release performance of coating on the bristle when used for application of coating such as in a paintbrush, mascara brush, nail polish brush or cosmetic brush.

DETAILED DESCRIPTION OF THE INVENTION

Figure 1:
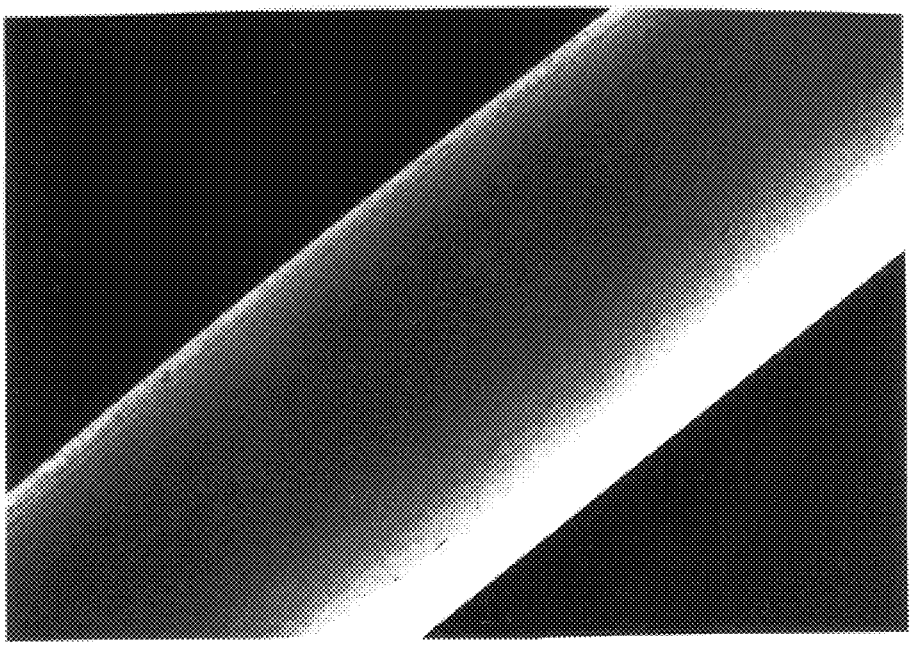
FIG. 1 (PRIOR ART)
FIG. 1 is an illustration of one brush bristle in a brush of the prior art, the brush having a handle 2 and a ferrule 4.

The filaments of the present invention are prepared by equipment that is traditionally used for extruding, stretching and tapering filaments in the manufacture of solid, tapered thermoplastic bristles. To produce tapered filament, the filament is drawn as described, for example, in U.S. Pat. No. 2,418,492 hereby incorporated by reference.

Thermoplastic polymer resin pellets are blended with the clay or silica additive. The blended resin is then fed to an extruder which melts the thermoplastic resin and transports the melted polymer. The clay is added at a loading ratio of from 0.1% to 10% by weight of the total composition. Loading below 0.1% by weight of the total composition does not achieve the desired performance characteristics. Loading above 10% may result in a less than optimum extrusion process, such as the breaking of filaments or difficulty drawing the filaments. The particularly preferred embodiment of a filament of the present invention contains about 5% by weight of the total composition of the clay or silica additive.

The melted polymer is extruded through a spinneret to form filament strands. The strands are quenched for solidification in a cooling bath, typically filled with water. The filaments are then drawn in accordance with a repetitive schedule of linear rates comprising a period of acceleration and deceleration, and a period of uniform withdrawal. In general, such filaments are tapered to produce a tip diameter that is about from 0.5 to 0.75 times the diameter of the butt diameter. Each filament is then oriented, stretched between two roll sets by running the second roll set faster than the first roll set, to improve longitudinal strength of the filament. The oriented filament may then be heated to induce partial crystallization rendering good bend recovery. The heat setting is typically carried out in a gas such as by blowing hot air over the filament for about 30 to 90 seconds, or in a liquid bath such as by passing the filament through a bath of oil for about 2 to 10 seconds.

The filaments are then cut at each point of minimum diameter and gathered as bundles of product. Each bundle is again cut at the center and the ends are trimmed to produce two bundles suitable for further processing into brushes. The individual bristles may be tipped and flagged by conventional procedures as described, for example, in U.S. Pat. Nos. 2,697,009 and 2,911,761 hereby incorporated by reference. The bristles are then fabricated into brushes using techniques well known in the art.

The filaments of the present invention can be prepared from a wide variety of thermoplastic polymers including, polyamides, polyesters and polyolefins, styrenes, fluoropolymers, polyvinylchloride, polyurethane, polyvinylidene chloride, polystyrene and styrene copolymers, and any combination thereof. Polyamides preferred in brush manufacturing include nylon 6, nylon 11, nylon 6,6, nylon 6,10 nylon 10,10, and nylon 6,12. Nylon 6,12 is particularly preferred for paintbrush, mascara brush, nail polish brush and cosmetic brush applications. The filaments of the present invention when produced with nylon 6,12 have a flex modulus of 430 to 630 ksi, a tensile strength of 37 to 80 ksi, a breakload of 0.80 to 12 lb, an elongation of 20 to 50% and bend recovery of 90 to 100%.

Figure 4:
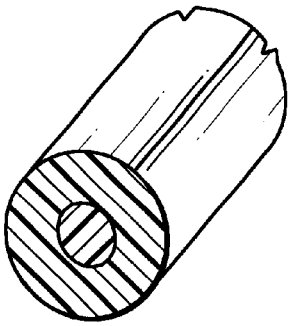
FIG. 4 is an illustration of a brush bristle prepared from a filament having a flagged tip.

Polyesters that have been found particularly well suited for bristle manufacture include polytbutylene terephthalate and polyethylene terephthalate and blends thereof. Of the many polyolefins which can be used for bristle manufacture, polypropylene is preferred. The filaments may also be prepared by a coextrusion of one or more polymers to form a coaxial structure, a concentric structure or other configuration. A portion of a brush bristle prepared from a filament having a coaxial structure is shown in FIG. 4.

Preferred clay and silica additives of the present invention have a particle size of between 0.01 $\mu$m to 100 $\mu$m. Many types of additives may be used including, but not limited to, rubber particles, aragonite clay, calcium carbonate, orthorhombic clays, calcite clay, rhombohedral clay, kaolin clay, bentonite clay, dicalcium phosphate, tricalcium phosphate, calcium pyrophosphate, isoluble sodium metaphosphate, precipitated calcium carbonate, magnesium orthophosphate, trimagnesium phosphate, alumina, hydrated silica xerogel, metal aluminosilicate complexes, sodium aluminum silicates, zirconium silicate, silicon dioxide, silicon carbide. The clays may be either hydrous or anhydrous and with or without surface modifiers. Examples include, but are not limited to, Hydrite UF, Hydrite 121-S and Hydrite Flat D, manufactured by the Dry Branch Kaolin Co. of Dry Branch, Georgia; and Burgess 2211, manufactured by Burgess Pigment Co. of Sandersville, Ga.

Figure 2:
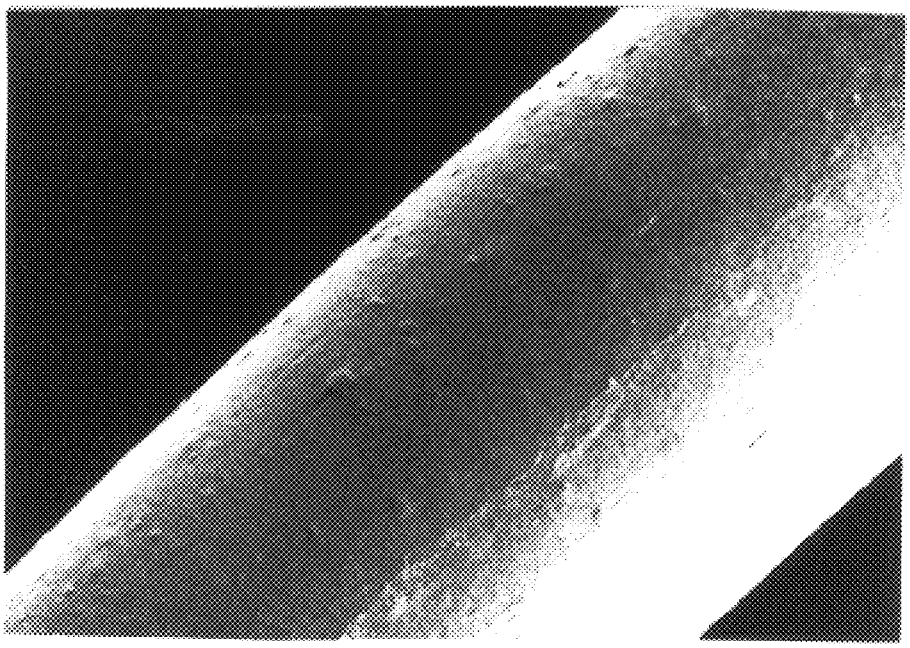
FIG. 2 is an illustration of one brush bristle in a brush of the present invention, the brush having a handle 2 and a ferrule 4.
Figure 3:
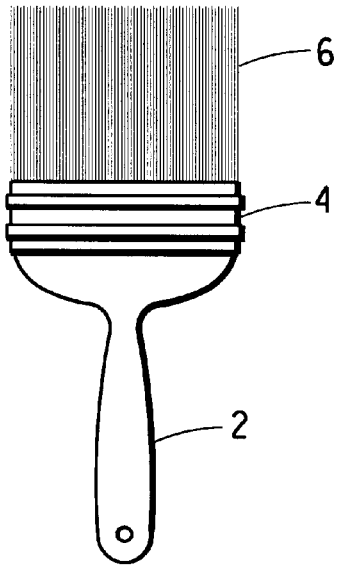

The clay or silica additive modifies the surface of the bristle, thus reducing the surface friction between bristles, which improves the coating performance when used in a brush application. Coating pickup, paint release, and paint stripe length are increased significantly. FIG. 2 illustrates the modified surface of a filament used as a bristle in a brush of the present invention as compared to the surface of a filament used As a bristle in a brush of the prior art, as illustrated in FIG. 1.

The brush bristles of the present invention have tip diameters of 0.003 in to 0.015 in and butt diameters from 0.005 in to 0.020 in. The brush bristles may be of any length and are limited only by their use in a particular application. For the paintbrush application, the preferred length of the bristles is between 2.00 in and 5.00 in, the butt diameter is preferably between 0.007 in and 0.015 in, and the tip diameter is preferably between 0.004 in and 0.010 in. In a particularly preferred embodiment of the mascara brush, the preferred length of the bristles is between 0.50 in and 2.00 in having a preferred butt diameter of 0.005 to 0.010 in and tip diameter of 0.003 to 0.005 in. For other applications, the preferred thickness of the bristles is selected to provide a level of functionality for the individual application.

Figure 5:
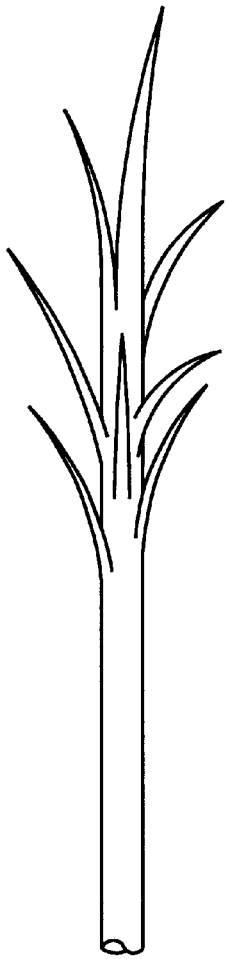
FIG. 5 is an illustration of a brush bristle prepared from a filament having a flagged tip.

The bristles of the present invention may be of different cross-sectional shapes, which are produced by extruding through different capillary shapes within the spinneret plate of the spinneret. Depending on the desired application of the bristles, using conventional techniques known in the art, each filament produced can be straight, curved, looped or arched. The bristles of the present invention can be produced in any color by blending the polymer with different colorants or by other coloring techniques known in the art. Also, the bristles can be easily tipped, flagged, or processed in the same manner as standard solid round tapered filaments. A brush bristle prepared from a filament having a flagged tip is shown in FIG. 5.

The present invention is further illustrated by the following specific and comparative examples.

EXAMPLE 1

Nylon 6,12 polymer resin (commercially available under the product name ZYTEL(® from E. I. du Pont de Nemours and Company of Wilmington, Del.) was blended with 10% by weight of the total composition of clay concentrate (commercially available from Chroma Corp. of McHenry, Ill.). The clay concentrate consisted of 50% by weight of Burgess 2211 clay in ZYTEL® 6,12 nylon resin, (manufactured by Burgess Pigment Co. of Sandersville, Ga.). The nylon and clay concentrate blend was gravity fed to the extruder.

A 120 hole spinneret plate with 0.031-inch diameter round capillaries was installed into the spinneret and the polymer was extruded at 240° C. and quenched in 25° C. water located approximately 1.0 in below the spinneret plate. The resulting filaments contained 5% by weight of the Burgess 2211 clay. The resulting filaments were tapered using rubber pinch rolls which were operated at a cyclically varying surface speed as described in U.S. Pat. No. 2,418,492 which resulted in a correspondingly varying strand caliper from 0.016 to 0.024 in. The tapered filaments were oriented by a draw ratio of 3.75:1 to obtain varying strand diameters of 0.008 to 0.012 in. The filaments were heat set by passing through a 170° C.–180° C. oven. After spinning, drawing, and heat setting, the filaments were cut at each point of minimum diameter and gathered as bundles of product. Rubber bands were placed on the bundles and each 2.0-inch diameter bundle was again cut at the center and ends trimmed to produce two bundles suitable for further processing into paintbrushes. The two bristle bundles produced were of a solid round diameter and measured 3.50 in and 3.75 in in length.

The bristle bundles were then fabricated into two three-inch wall paintbrushes using commercial manufacturing techniques. Brush 1 was composed of 100% of the nylon filaments of the present invention. Brush 2 was composed of a blend of the nylon filaments of the present invention and of commercially available solid round polyester filaments. Brush 1 and Brush 2 were evaluated for paint performance and compared to three of the best commercially available professional brushes, Brush 3, Brush 4, and Brush 5, all composed of a blend of commercially available solid round nylon and polyester filaments of different sizes and lengths.

The brushes were evaluated by the procedure described in DuPont® Filaments Marketing Publication, "Paintbrush Evaluation Test." The "Paintbrush Evaluation Test" measures a paintbrush's ability to pick up paint, to release the paint (lay paint down on a surface), and to visually show how effectively this is done. These key results are measured by the "Paint Pickup", "Paint Laydown" and "Stripe Length" measurements. The Paint Stripe test simulates a painter painting a horizontal stripe on a vertical wall. A special black lacquered paper is used for the paint stripe test. The Stripe Length is the actual measurement on the paint stripe from the beginning of the stripe to the point where the brush begins to skip. Although this skip point is somewhat subjective, as long as all the stripes are judged on the same basis, the comparative results will be consistent. The procedure to measure the three test criteria includes the following steps:

(1) Weigh the clamp and brush, including handle, and record the "Clamp-Brush" weight.
(2) Dip the brush for 30 seconds into the paint to a predetermined length of the bristle then let the paint drip for 30 seconds.
(3) Weigh the clamp and brush with the paint and record the "Before" weight.
(4) Paint one left to right stripe with the dipped brush without letting the brush paint a return stripe.
(5) Quickly reweigh the clamp and brush and record the "After" weight.
(6) Calculate the Paint Pickup by subtracting the "Clamp-Brush" weight from the "Before" weight.
(7) Calculate the Paint Laydown by subtracting the "After" weight from the "Before" weight.
(8) Once the paint is dry, measure the length of the stripe from where the paint begins to where the brush begins to skip. This measurement is the "Stripe Length."

Results of the test are shown in Table 1. The results demonstrate a significant improvement in paint performance of the brushes of the present invention (Brushes 1 and 2) when compared to the best brushes available today (Brushes 3, 4 and 5).

TABLE 1

| | Paint Performance | | |
|---|---|---|---|
| Brush | Paint Pickup (g) | Paint Laydown (g) | Paint Stripe Length (in.) |
| Brush 1 | 37 | 4.3 | 18.00 |
| Brush 2 | 32 | 5.2 | 23.50 |
| Brush 3 | 21 | 3.3 | 14.75 |
| Brush 4 | 25.3 | 3.2 | 14.25 |
| Brush 5 | 25.4 | 3.5 | 14.00 |
| Brush 6 | 32.9 | 6.1 | 20.00 |
| Brush 7 | 32.4 | 4.6 | 13.75 |

The performance results of Brush 1 and Brush 2 for paint pickup and paint laydown were compared to the results of Brush 5 since Brush 5 achieved the best result for these tests. The performance results for paint stripe length were compared to the results of Brush 3 since Brush 3 achieved the best result for that test. Brush 1 showed a 46% improvement in paint pickup, a 23% improvement in paint laydown, and a 22% improvement in paint stripe length. Brush 2 showed a 26% improvement in paint pickup, a 49% improvement in paint laydown and a 60% improvement in paint stripe length. These results show that the filaments of the present invention, especially when blended with polyester filaments in a brush, achieve a significantly better coating performance than standard nylon and polyester filaments.

EXAMPLE 2

The filaments of Example 2 were produced using the same process as described in Example 1 above. Filaments were produced having lengths or 3.00 in, 3.25 in, 3.50 in, and 3.75 in. A second set of filaments was produced using a 180 hole spinneret plate with 0.026-inch diameter capillaries. The resulting extruded filaments had varying diameters of 0.010 to 0.018 in. These were drawn at a ratio of 3.75:1 and heat set to produce filaments with varying diameters of 0.005 to 0.009 in. The resulting filaments were cut to lengths of 3.25 in and 3.50 in. These 6 products were assembled into a three-inch wall brush, Brush 6, using a commercial manufacturing process.

Brush 6 was evaluated using the DuPont™ Filaments "Paintbrush Evaluation Test" described in Example 1. As in Example 1, the performance results for paint pickup and paint laydown of Brush 6 were compared to the results of Brush 5 since Brush 5 achieved the best result for these tests. The performance result for paint stripe length was compared to the results of Brush 3 since Brush 3 achieved the best result for that test. Results for Brush 6 are shown in Table 1. Again, significant improvement was demonstrated using the filaments of the present invention achieving a 30% improvement in paint pickup, a 32% improvement in paint release, and a 36% improvement in paint stripe length.

EXAMPLE 3

Using the same process as described in Example 1, filaments were prepared from a blend of ZYTEL(® 6,12 nylon and 2.5% of the clay concentrate, resulting in a bristle containing 1.25% by weight of clay additive. The filament was cut to a length of 3.75 in and assembled into a three-inch wall paintbrush, Brush 7, using a commercial manufacturing process. The brush was evaluated using the DuPont(® Filaments "Paintbrush Evaluation Test" and compared to the results of Brush 5 and Brush 3 as described in Example 1. Results are shown in Table 1 for Brush 7. Although produced with one size of filaments of the present invention, Brush 7 still showed a 28% increase in paint pickup, a 31% improvement in paint laydown, and almost an equivalent performance in paint stripe length (93% of Brush 3's paint stripe length).

Although the invention has been described with reference to several particular embodiments, it will be understood to those skilled in the art that the invention is capable of a variety of alternative embodiments within the spirit and scope of the appended claims.

I claim:

1. A brush for the application of paint, comprising a handle; a ferrule; and, as bristles contained within the ferrule, drawn, tapered filaments that have a tip and a butt, and are produced from a composition comprising a thermoplastic polymer and a particulate additive selected from the group consisting of aragonite clay, calcium carbonate, orthorhombic clays, calcite clay, rhombohedral clay, kaolin clay, bentonite clay, dicalcium phosphate, tricalcium phosphate, calcium pyrophosphate, isoluble sodium metaphosphate, precipitated calcium carbonate, magnesium orthophosphate, trimagnesium phosphate, alumina, hydrated silica xerogel, metal aluminosilicate complexes, sodium aluminum silicates, zirconium silicate, silicon dioxide, silicon carbide, and rubber particles; wherein the particulate additive has particle size between about 0.01 microns and about 100 microns; wherein one or more of the filaments has a circular cross section; and wherein one or more of the filaments has a length of between about 2.00 inches and about 5.00 inches, a butt diameter between about 0.007 inches and about 0.015 inches, and a tip diameter between about 0.004 inches and about 0.010 inches.

2. A brush according to claim 1 wherein one or more of the filaments has a tip diameter that is from about 0.5 to about 0.75 times the diameter of the butt.

3. A brush according to claim 1 wherein one or more of the filaments is tipped or flagged.

4. A brush according to claim 1 wherein one or more of the filaments has a coaxial structure.

5. A brush according to claim 1 wherein the thermoplastic polymer is selected from the group consisting of polyamides, polyesters, polyolefins, styrenes, fluoropolymers, polyvinylchloride, polyurethane, polyvinylidene chloride, polystyrene and styrene copolymers, and any copolymers and blends thereof.

6. A brush according to claim 1 wherein the thermoplastic polymer is a polyamide and the particulate additive is kaolin clay.

7. A brush according to claim 1 wherein the particulate additive is present in the composition in an amount of about 0.1 to about 10% by weight of the total composition.

* * * * *